United States Patent [19]

Bryant

[11] Patent Number: 4,579,479

[45] Date of Patent: Apr. 1, 1986

[54] POTHOLE PATCHING AND ROADWAY SURFACE PAVING MACHINE

[76] Inventor: Joseph H. Bryant, Thorndike, Me. 04986

[21] Appl. No.: 604,062

[22] Filed: Apr. 26, 1984

[51] Int. Cl.[4] ..... E01C 19/23

[52] U.S. Cl. ..... 404/103; 404/107

[58] Field of Search ..... 404/101-104, 404/107-112, 128, 129; 198/311, 317, 546, 548, 553, 558, 589; 222/410, 412, 413, 626

[56] References Cited

U.S. PATENT DOCUMENTS

| | | | |
|---|---|---|---|
| 688,912 | 12/1901 | Watts | 198/546 X |
| 2,762,276 | 9/1956 | Mauch | 404/103 |
| 2,856,062 | 10/1958 | Kling | 198/317 |
| 2,991,895 | 7/1961 | Dietzenbach | 198/317 X |
| 3,477,535 | 11/1969 | Wyatt | 404/112 |

*Primary Examiner*—James A. Leppink
*Assistant Examiner*—John F. Letchford
*Attorney, Agent, or Firm*—Daniel H. Kane, Jr.

[57] ABSTRACT

A pothole patching and roadway surface repair and paving machine is described having a mobile chassis frame mounted on wheels for transport over a roadway. The machine is formed with an elongate boom mounted on the frame at an upwardly directed angle with the lower end of the boom formed with an opening position for receiving repair material dispensed from a source. The boom is constructed and arranged with a boom conveyor extending internally the length of the boom for conveying repair material dispensed from the source to the top of the boom. The boom is mounted on the frame for movement right and left over a roadway surface on a vertical pivot axis and for movement of the boom up and down on a horizontal pivot axis for varying the upwardly directed angle of the boom. An elongate chute or hollow stick is pivotally mounted to the upper end of the boom at a downwardly directed angle. The chute is pivotally mounted for varying the downwardly directed angle relative to the boom and is arranged to receive repair material conveyed to the top of the boom and drop the repair material through the chute to selected locations on the ground. A roller assembly is coupled to the lower end of the chute for rolling repair material dispensed from a source via the boom and chute to the selected locations on the roadway surface. Operator controls are provided for control of independent degrees of motion of the various elements of the machine.

27 Claims, 14 Drawing Figures

73
65
72
66
70
71

70a
70b 44
42
35
46
54
40

36
37
35
32
34

33
33
35
35
32
34

POTHOLE PATCHING AND ROADWAY SURFACE PAVING MACHINE

TECHNICAL FIELD

This invention relates to a new machine for patching potholes, repairing roadway surfaces, and paving surface areas of roadways and sidewalks. The pothole patching and roadway surface paving machine may be either an apparatus suitable for towing by, for example, a dump truck, or an independently driven special purpose vehicle.

BACKGROUND ART

According to conventional procedures, pothole patching and roadway surface repair is carried out manually from the back of a dump truck or vehicle bin. It is necessary that the workers climb up and down on the truck or other vehicle and walk around on the roadway in the presence of vehicle traffic. The pothole patching and roadway repair material is typically shoveled, dispensed and tamped manually, though perhaps a separate steam roller may be available for packing the material.

A disadvantage of the current methods is that workers are subjected to safety hazards during movement on and off the truck and over the roadway surface. Furthermore, the manually handling of the cold patch, hot patch, or other patching and repair material results in uneven distribution and packing.

OBJECTS OF THE INVENTION

It is therefore an object of the present invention to provide a new machine for automated patching of potholes and repair and paving of roadway surfaces and sidewalks.

Another object of the invention is to provide a pothole patching and roadway surface repair and paving machine with an operating seat removed from traffic hazards with fully automatic operator controls for accurate placement and distribution of repair material and uniform packing or rolling of deposited repair material.

A further object of the invention is to provide a pothole patching and roadway surface repair and paving machine which may be towed along the roadway by a dump truck or other vehicle or which may be constituted as a separate special purpose vehicle or retrofitted on a chassis with its own drive.

DISCLOSURE OF THE INVENTION

In order to accomplish these results the invention provides a mobile chassis frame mounted on wheels for transport over a roadway and elongate boom mounted on the frame at an upwardly directed angle with the lower end of the boom formed with an opening positioned for receiving repair material dispensed from a source such as a hopper. The boom is constructed and arranged with a boom conveyor extending internally the length of the boom for conveying repair material dispensed from the source to the top of the boom. The boom is mounted on the frame for movement right and left over a roadway surface on a vertical pivot axis and for movement of the boom up and down on a horizontal pivot axis for varying the upwardly directed angle of the boom.

The invention also contemplates an elongate chute pivotally mounted at the upper end of the boom at a downwardly directed angle. The chute is pivotally mounted for varying the downwardly directed angle of the chute relative to the boom for receiving repair material conveyed to the top of the boom and for dropping the repair material through the chute to selected locations on the ground. According to the invention a roller assembly is coupled adjacent to the lower end of the chute for rolling repair material dispensed from the source, such as a hopper, via the boom and chute to selected locations on the roadway surface.

According to the invention, the automatic controls for operation of the patching, repair, and paving machine include a swing control for controlling pivotal motion of the boom from left to right on the frame across the roadway, a boom control for controlling pivotal motion of the boom up and down varying the upwardly directed angle and thereby effectively extending and retracting the end of the boom relative to the frame, and a chute control for controlling pivotal motion of the chute relative to the boom for varying the downwardly directed angle of the chute and further effectively extending and retracting the lower end of the chute relative to the frame. A feature and advantag operator controls, according to the invention, is that the operator can accurately control placement of repair material on the roadway surface. For fine control the invention adds a deflector pivotally mounted at the lower end of the chute for deflecting repair material dropping through the chute at an angle relative to the chute and a deflector control for controlling the pivotal angle of the deflector.

In the preferred example embodiment the mobile chassis frame is formed with an operator's seat mounted on the side of the frame at the shoulder side of the road away from the traffic. The operator controls, including the swing, boom, chute and deflector controls, are conveniently positioned at the operator's seat for operating, for example, respective hydraulic cylinders for fine control over placement of repair material dispensed from a hopper or other source to targeted locations on the roadway surface. The boom conveyor may be an internal auger driven by an auger motor at the top of the boom also controlled from the operator's seat. If the hopper bin is formed directly on the mobile chassis frame, a hopper conveyor such as an auger is mounted in the base of the hopper bin for conveying repair material to a base opening and for dispensing the material to the boom conveyor. The hopper conveyor, such as an auger, is driven by an auger motor also controlled at the operator's seat along with the boom auger motor for controlling the rate at which repair material is dispensed from the hopper to targeted locations on the roadway surface.

In the preferred embodiment the roller assembly comprises a roller mounted at the lower end of the chute extending below the end of the chute so that the weight of the machine can be brought to bear on the roller for compressing repair material dispensed at a targeted location on the roadway surface. The rolling and pressing action is accomplished by operation of the boom control and chute control. The roller assembly includes a roller frame and a roller mounted for rotation on a first horizontal axis of rotation for rolling repair material. The roller is mounted in gimbal fashion for self levelling rocking motion on a second horizontal axis at right angles to the first horizontal axis.

According to the invention, the preferred roller assembly includes a sleeve or flange rotatably coupled to the chute for rotation of the roller assembly about a substantially vertical axis for orienting the roller at different ahgles relative to the direction of a roadway and on different sides of the chute. A feature and advantage of this arrangement is that the roller assembly may be oriented for rolling and pressing repair or paving material previously dispensed through the chute over a large surface area. In this manner the machine may be used for paving new areas on roadways and sidewalks.

According to another feature of the roller assembly, a levelling bar frame is pivotally mounted to the roller frame on a substantially horizontal pivot axis. A levelling bar frame control such an hydraulic cylinder is coupled between the roller frame and levelling bar frame for controlling the level of the levelling bar frame for levelling repair material deposited on a roadway surface by sweeping the roller assembly back and forth over the surface area of deposited material.

In the preferred form of the invention the deflector at the base of the chute is in the form of a truncated cone or funnel pivotally mounted at the lower end of the chute. The angular orientation of the dispensing cone is controlled by an hydraulic cylinder for fine control of the target location for the repair material.

Other objects, features, and advantages will become apparent in the following specification and accompanying drawings.

BRIEF DESCRIPTION OF THE DRAWINGS

FIG. 3 is a detailed fragmentary plan view of the cradle which supports the boom and rolls back and forth on the platform of the mobile chassis frame about a vertical pivot axis.

FIG. 3A is a detailed fragmentary side view of the cradle showing the depending front edge of the cradle for engaging the circular front edge of the platform on the mobile chassis frame.

FIG. 4A is a plan view of the boom showing the opening in the top of the housing over the horizontal section of the auger for receiving repair material dispensed from the hopper bin.

FIG. 6 is a front view of the elongate tapered chute pivotally suspended from the top of the boom, while FIG. 6A is an end view showing the larger cross section of the chute near the top and FIG. 6B is an end view showing the smaller cross section at the bottom of the chute.

FIG. 6C is a fragmentary side view of the main body portion of the tapered chute showing the two piece construction.

DESCRIPTION OF PREFERRED EXAMPLE EMBODIMENTS AND BEST MODE OF THE INVENTION

Figure 1:
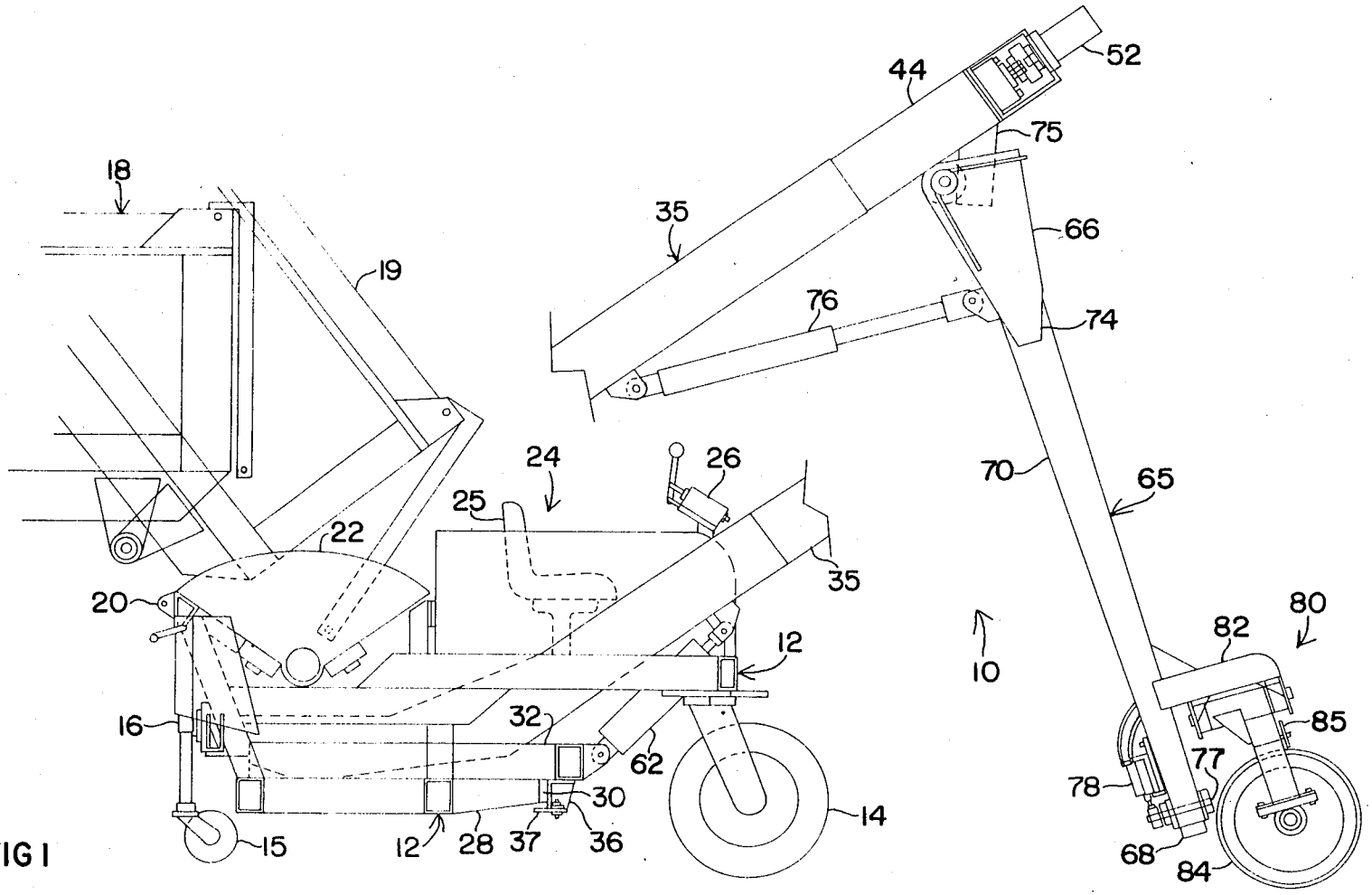
FIG. 1 is a side view of the pothole patching and roadway surface repair and paving machine with a break in the boom for inclusion of the figure on a single sheet and showing the mobile chassis frame and hopper bin positioned below the bed of a dump truck.
Figure 2:
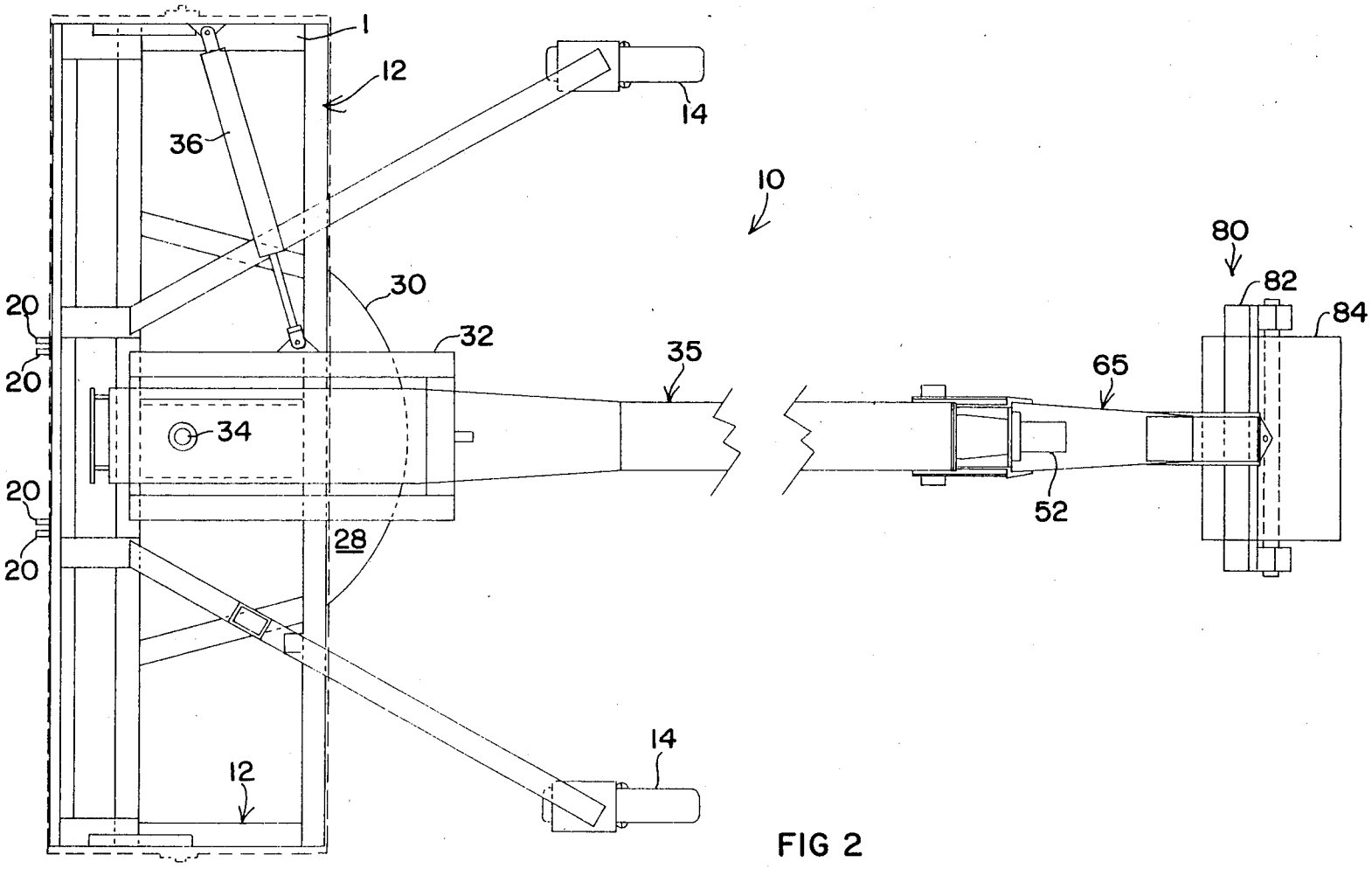
FIG. 2 is a plan view of the machine with the hopper bin and operator's seat removed for showing the mobile chassis frame and with a break in the boom for inclusion of the figure on a single sheet.

A pothole patching and roadway surface repair machine 10 according to the present invention is illustrated in FIGS. 1 and 2. The machine is assembled on a mobile chassis frame 12 mounted at the trailing end on a set of major wheels 14 and at the leading end on a set of minor wheels 15. The smaller wheels 15 may be retracted in the telescoping post 16 or may be entirely removed as hereafter described when the machine is coupled to a truck such as dump truck 18 at the truck hitch 20. On the leading end of the mobile chassis frame in the direction of towing is mounted an elongate hopper bin 22 extending across the frame. On the far side of the frame is also installed an operator section 24 which includes the operator seat 25 and controls 26.

The mobile chassis frame 12 is shown with greater clarity in FIG. 2 where the hopper bin 22 and operator section 24 have been removed. Referring to both FIGS. 1 and 2, the frame 12 includes a platform 28 having a front edge or leading edge 30 in the configuration of an arc of a circle. Resting on the platform 28 is a cradle 32 which is mounted for rolling movement back and forth on the platform 30 about the vertical pivot axis 34.

Only portions of the cradle 32 are shown schematically in FIGS. 1 and 2 and the further details of the cradle are described with reference to FIGS. 3 and 3A. The cradle 32 includes roller arms 33 in which are mounted rollers 35 so that the rollers extend below the bottom of the cradle for resting on the platform 30 and for rolling motion back and forth on the platform 30 about the vertical pivot axis 34. For pivot axis 34 a standard tractor trailer high carbon steel fifth wheel pin with a larger diameter and a steel cast head at the top of the pin may also be used. The free end of cradle 32 is formed with a depending edge 36 including a backward projection 37 which engages the circular edge 30 of the platform 28 thereby retaining the cradle against the platform.

An elongate boom 35 is mounted on the frame 12 at an upwardly directed angle secured to the cradle 32 for swinging action back and forth on the cradle which rotates on the vertical pivot axis 34. The swinging action back and forth of boom 35 on cradle 32 is controlled by the swing control or swing hydraulic cylinder 36 which is connected between the cradle 32 and frame 12.

Figures 3, 3A, 4A, 6, 6A, 6B, 6C:
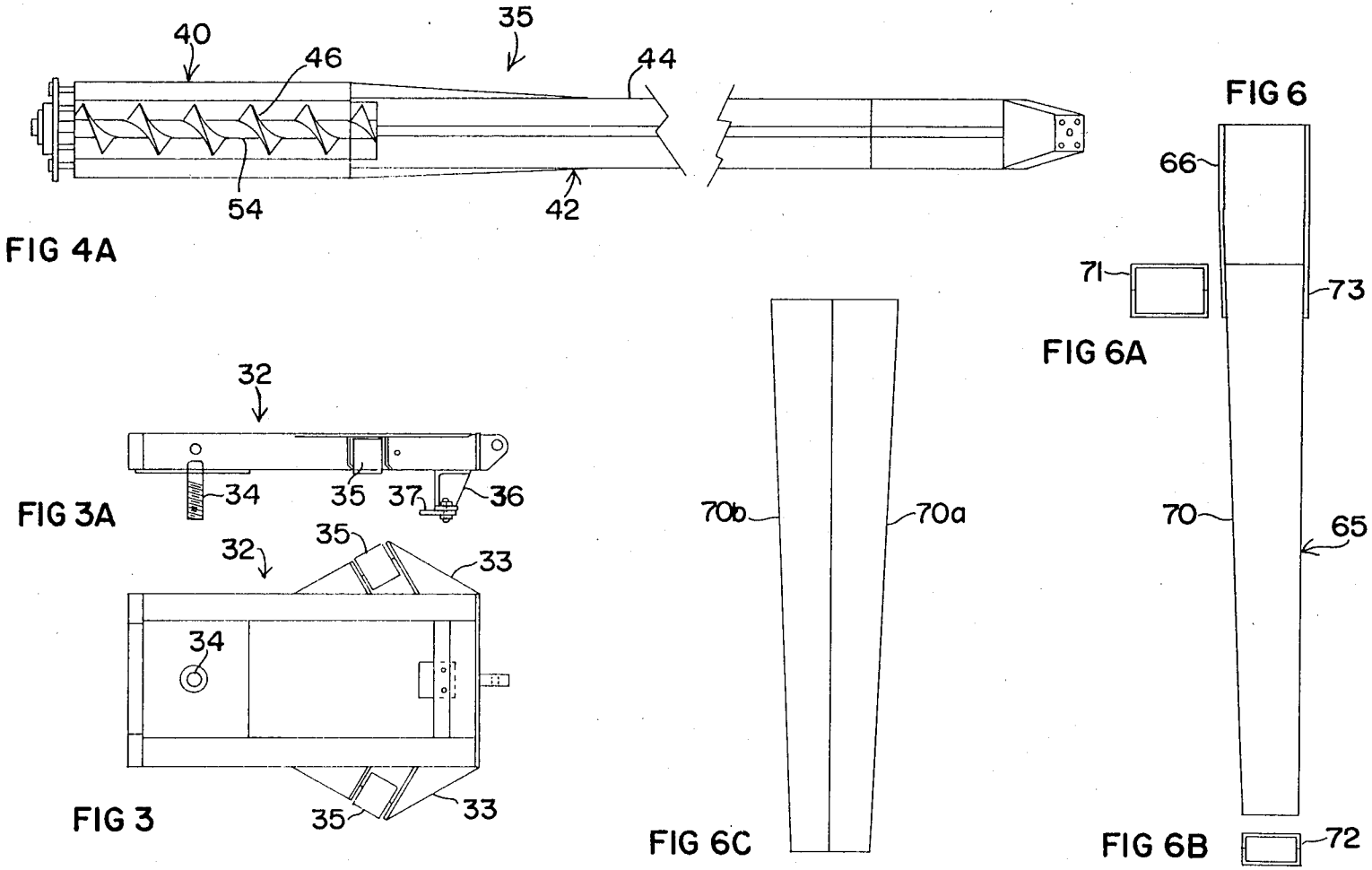
Figure 4:
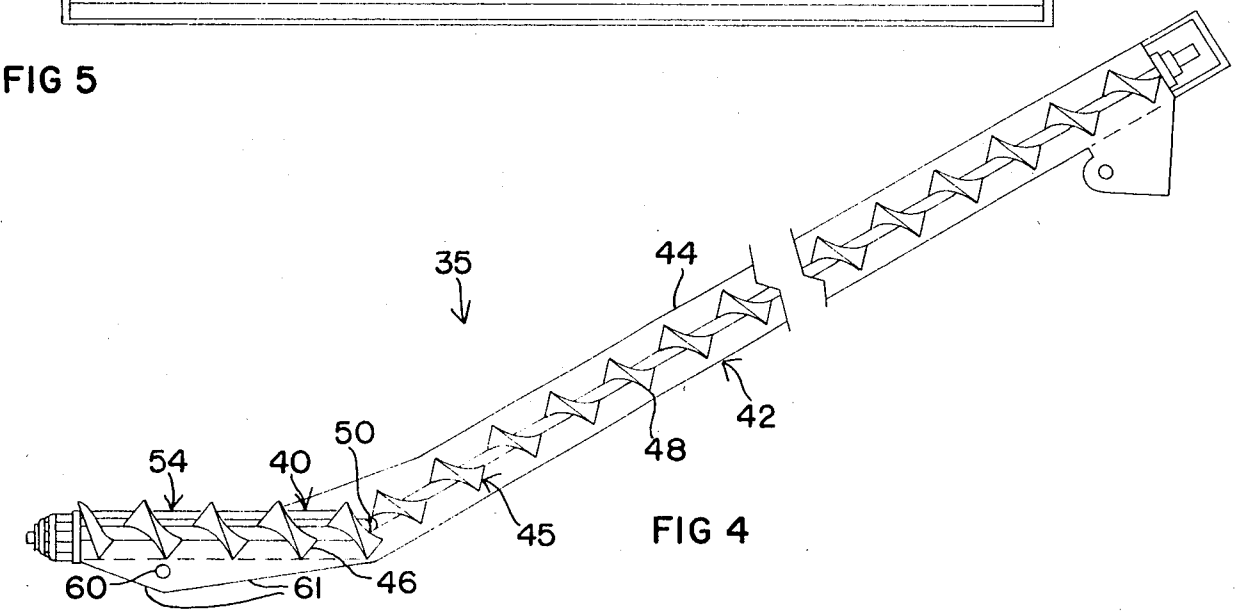
FIG. 4 is a side view of the boom with the housing cut away showing the internal boom auger in two sections coupled at a universal joint.

Referring also to FIGS. 4 and 4A, the boom 35 includes a substantially horizontal length 40 for positioning below the hopper bin as hereafter described and a second upwardly directed length 42 joined to the substantially horizontal length to form a unitary boom for pivoting or swinging movement left and right on the cradle 32. The elongate boom is formed with a housing 44 through which extends internally a conveyor 45 substantially the entire length. In the preferred example of FIGS. 4 and 4A the conveyor 45 is an auger including a substantially horizontal length 46 and an upwardly directed length 48 coupled at a universal joint. The coupled ends of the auger lengths 46 and 48 adjacent to the universal joint 50 may be formed with extending tabs which interleave during rotation of the auger to provide continuous lift or forward impetus to repair material conveyed upwardly the length of the boom. The auger conveyor 45 is driven in rotation by the boom auger motor 52 mounted at the top of the boom as shown in FIG. 1.

Figure 5:
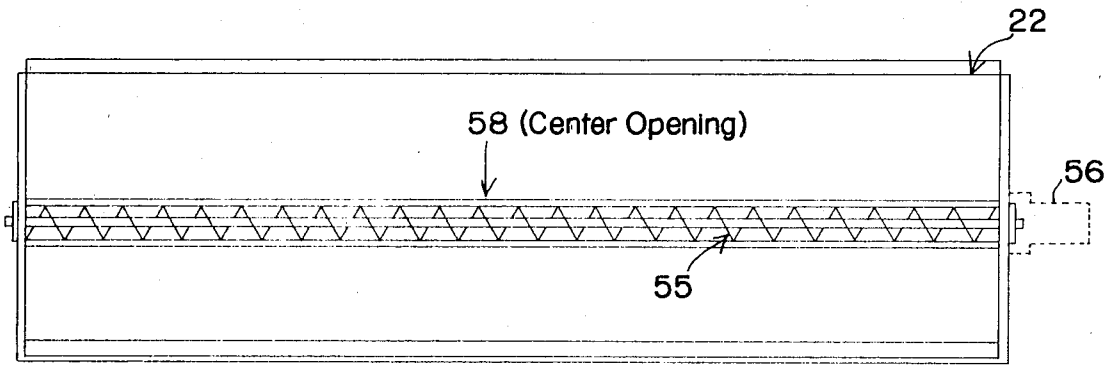
FIG. 5 is a detail plan view of the hopper bin showing the hopper auger along the base of the hopper bin.

The top of the housing 44 along the substantially horizontal length 40 of boom 35 is formed with an opening 54 through which roadway surface repair material may be delivered from the hopper 22 shown in further detail in FIG. 5. As shown in FIGS. 1 and 5, the hopper bin 22 is formed with a hopper auger at the base of the hopper bin extending the entire width of the bin across the frame 12. The hopper auger 55 is driven to rotation by hopper auger motor 56 so that repair material, such as cold patch or hot patch, deposited in the hopper bin 22, is conveyed from both sides to the center 58. There it drops through a center opening not visible behind the hopper auger 55 through the hole 54 in the top of the horizontal length 40 of boom 35. Referring to FIG. 1, road surface repair material is periodically replenished by depositing from the bed 19 of dump truck 18 into the hopper bin 22 from which the repair material is dispensed through the center opening of the hopper to the lower end of the boom 35 and boom conveyor 45.

Looking at FIG. 5, the hopper auger motor 56 may alternatively be placed inside the frame of the hopper and below the bottom surface of the bin, offset from the auger axis. From this position the motor drives the auger with a chain and sprocket. This arrangement reduces the overall width of the machine by the length of the motor 56. Only the sprocket and chain remain outside the hopper frame with a shield over the moving parts.

Referring to FIGS. 1 and 4, the elongate boom 35 is connected to the cradle 32 by a horizontal bolt or pivot axis at 60 above the inclined or cut away surfaces 61 thereby permitting rocking motion of the boom 35 up and down on the horizontal pivot axis. Movement of the boom up and down on the horizontal pivot axis for varying the upwardly directed angle of the boom is controlled by the boom control or boom hydraulic cylinder 62 which is connected between the undersurface of the boom 35 and the cradle 32 as shown in FIG. 1.

Pivotally suspended from the upper end of boom 35 at a downwardly directed angle is the elongate chute or hollow stick 65 which tapers from a wide receiver 66 at the top to a narrower dispensing end at the bottom in which is mounted the deflector 68. Referring to FIGS. 1 and 6, the chute 65 is formed with a tapering main body 70 which may be constructed from two u-shaped tapering pieces joined along a seam. The cross sectional configuration or area 71 at the top of the main body 70 shown in FIG. 6A is larger than the cross sectional configuration or area 72 at the bottom of the main body 70 as shown in FIG. 6B. The receiver 66 is rigidly joined to the top of the main body 70 with overlapping sides 73 and guides 74 extending internally of the main body for delivering repair material falling from the outlet 75 formed in the housing 44 at the top of the boom 35. The receiver 66 rigidly joined to the main body 70 pivotally joins and mounts the chute 65 to boom 35.

The elongate chute 65 is pivotally mounted to the boom for varying the downwardly directed angle of the chute relative to the boom. The pivotal motion of the chute relative to the boom is controlled by the chute control or chute hydraulic cylinder 76 connected between the undersurfaces of the boom 35 and chute 65. Operation of the chute hydraulic cylinder 76 varies the downwardly directed angle of the chute effectively extending and retracting the lower end of the chute relative to the frame 12. Thus, operation and control of the swing hydraulic cylinder 36 boom hydraulic cylinder 62 and chute hydraulic cylinder 76 permits accurate control of placement of repair material on a roadway surface dispensed from hopper bin 22 via boom 35 through chute 65. Fine control over the placement of repair material on the roadway surface once the chute 65 is positioned at a desired location is accomplished by operation of a vane, damper or deflector 68 positioned at the cross sectional opening 72 at the bottom end of the chute 65. The deflector 68 is pivotally mounted on the pivot axis 77 and the angular orientation of the deflector 68 may be varied by the deflector control or deflector hydraulic cylinder 78 also mounted on the side of the chute 65 at its lower end. Thus, the deflector 68 can divert and deflect repair material dropping through the chute 65 in one direction or the other to the right or left by operation of the deflector hydraulic cylinder 78.

The roller assembly 80 is joined to the chute 65 at its lower end for rolling repair material dispensed through the chute at selected locations on a roadway surface. The roller assembly 80 includes a roller frame 82 and roller 84 extending below the end of the chute and the deflector 68 so that the weight of the pothole patching and roadway surface repair machine 10 can be brought to bear on the roller 84 by operation of the boom hydraulic cylinder 62 and chute hydraulic cylinder 76 for compressing repair material dispensed in a pothole or other targeted location on the roadway surface. The roller 84 is mounted on the side of the chute 65 away from the mobile chassis frame 12 and operator section 24 for visibility from the operator's seat 25 of the end of the chute and deflector 68 for visually monitoring repair material deposited at the target location.

In the roller assembly of FIGS. 1 and 2 a scraper bar 85 is adjustably mounted across the frame 82 adjacent to the surface of roller 84 to assist in scraping and removing repair material which may stick to the surface of the roller. Also mounted along the scraper bar are a row of nozzles, not visible, for spraying diesel oil or other petroleum liquid over the surface of the roller to further clean the roller surface and prevent repair material such as cold patch or hot patch from sticking to the surface. The line for delivery of diesel oil or other liquid to the spray nozzles or spray heads follows the chute and boom to the operator's section where a pump and spray control is provided.

Figure 7:
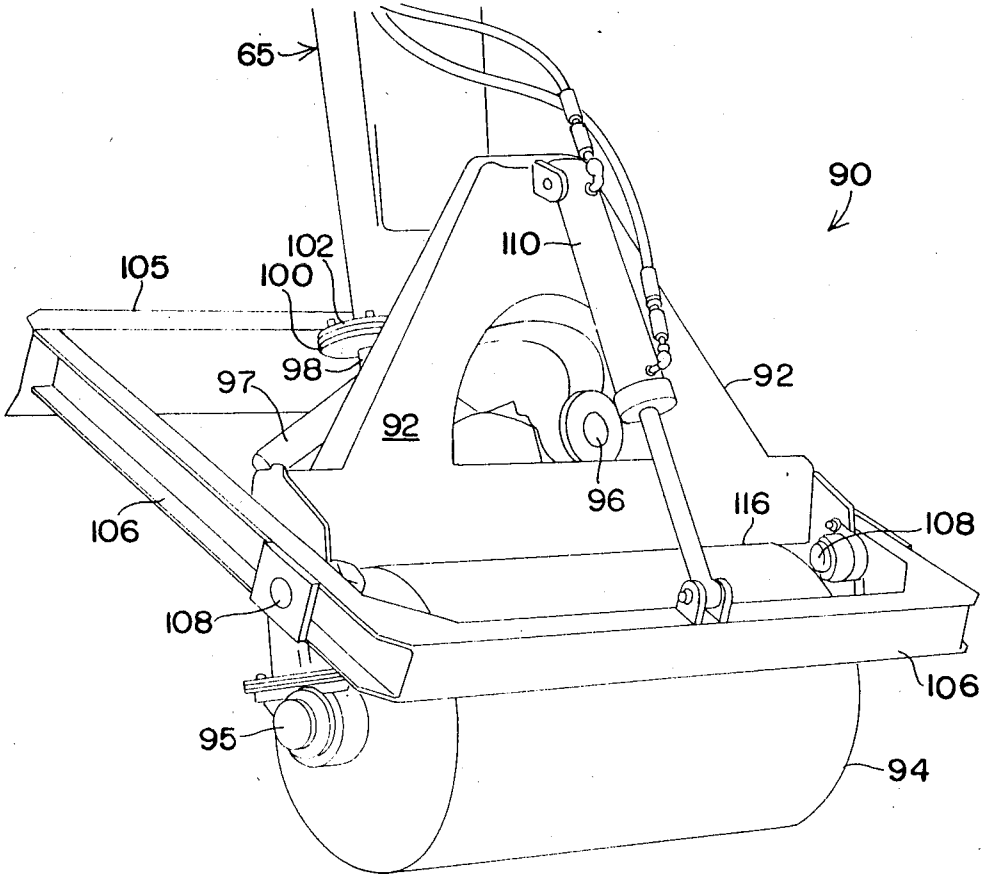
FIG. 7 is a fragmentary perspective view from the front of the preferred example embodiment of the roller assembly mounted at the end of the chute.
Figure 7A:
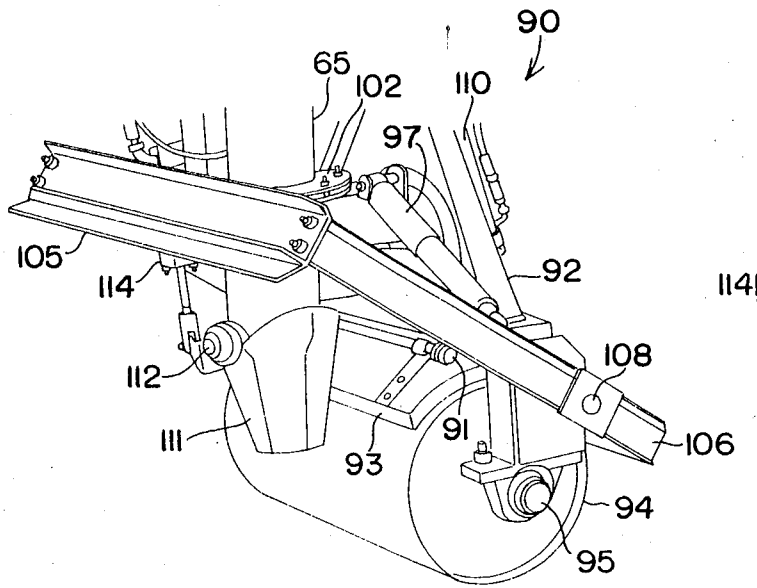
FIG. 7A is a fragmentary perspective view from the rear quarter of the preferred example embodiment roller assembly mounted at the end of the chute and also showing the truncated cone deflector at the end of the chute.

A preferred embodiment roller assembly 90 is illustrated in FIGS. 7 and 7A. In this arrangement the roller assembly comprises a roller frame 92 and a roller 94 mounted for rotation on a first horizontal axis of rotation 95 for rolling repair material. The roller 94 and roller frame 92 are mounted at the end of the chute for self leveling rocking motion right and left on a second horizontal axis 96 at right angles to the first horizontal axis. The rocking motion or self levelling right and left motion on horizontal axis 96 is dampened by an automobile type shock absorber 97 connected between the roller frame 92 and the roller assembly attachments to the chute.

Furthermore, the entire roller assembly 90 is rotatably coupled to the chute 65 on a sleeve 98 and rotatably engaging flanges within plates 100 and 102. Thus, the roller assembly 90 is rotatably coupled to the chute 65 for rotation of the roller assembly about a substantially vertical axis for positioning the roller 94 at different angles and different sides of the chute, for example up to 90°, as hereafter described with respect to FIG. 8.

The roller assembly 90 also includes a leveling bar 105 and leveling bar frame 106 pivotally mounted to the roller frame 92 for lowering or dropping and raising the leveling bar 105 on a horizontal axis 108 relative to the roller frame 90. A leveling bar control or leveling bar hydraulic cylinder 110 is connected between the leveling bar frame 106 and the roller frame 92 for controlling the level of levelling bar 105. In FIGS. 7 and 7A the leveling bar 105 is shown in raised position with hydraulic cylinder 110 extended. When hydraulic cylinder 110 contracts under control from the operator's section, the leveling bar 105 drops to a desired level for leveling repair material deposited in quantity on a roadway or sidewalk surface. A feature and advantage of the leveling bar 105 is that it can be dropped to a level below the roller 94 for leveling and smoothing repair material deposited on the roadway surface by motion of the boom and chute with the roller 94 maintained above the road surface. The leveling bar 105 of roller assembly 90 has particular application for paving large areas of roadway surface rather than merely patching potholes and small area surface defects.

As shown in FIG. 7A the chute 65 terminates at its lower end in a deflector 111 in the configuration of a truncated cone or funnel. The truncated cone deflector 111 is pivotally mounted to the end of the chute on horizontal pivot axis 112 and is provided with an extended arm coupled to a deflector control or deflector hydraulic cylinder 114 rigidly mounted on the side of chute 65. The deflector control hydraulic cylinder 114 upon extension and retraction varies the angle of the truncated cone deflector 111 for fine control in directing and determining the ultimate destination of repair material dispensed from the hopper bin via the boom and chute to targeted locations. The cross sectional area of the upper end of the truncated cone or funnel deflector 111 is greater than the cross sectional area of the lower end of the chute and encloses the end of the chute for receiving and dispensing the repair material.

For continuously cleaning the surface of roller 94, a spray boom 91 with nozzles, not visible, dispenses diesel fuel or similar material onto the "cocoa" mat or door mat material 93. The mat 93 disperses and applies diesel fuel or cleaning fluid over the surface of the roller 94. The mat 93 is mounted against the roller surface behind bar 116 for distributing the fluid and exerting abrasive scraping or cleaning action.

Figure 8:
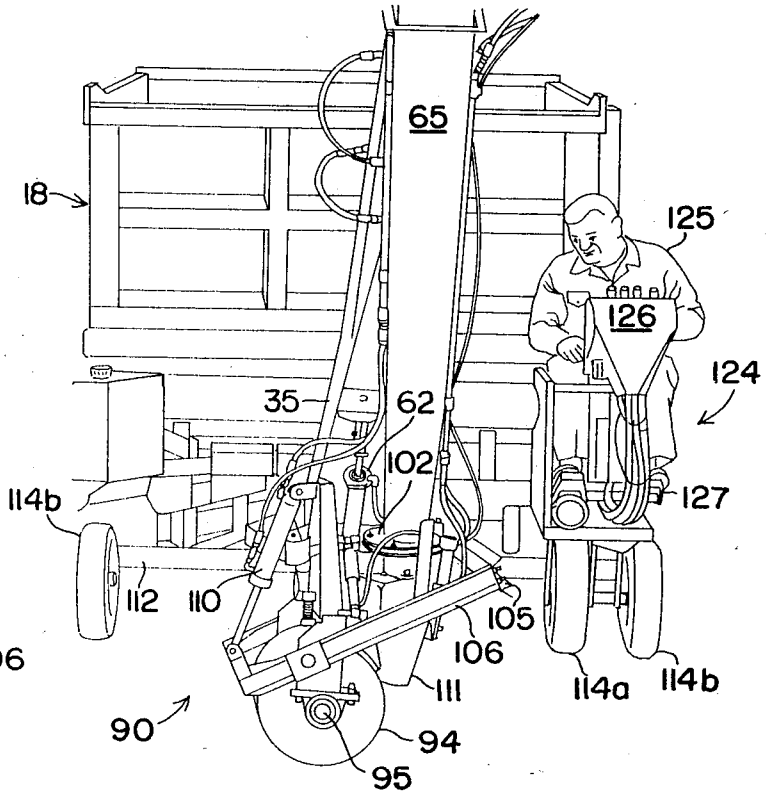
FIG. 8 is a fragmentary perspective view of the major portion of the pothole patching and road surface repair and paving machine in operative position for repairing or paving a relatively large surface area of a roadway or sidewalk.

A further novel application of the present invention is illustrated in FIG. 8. In this example the mobile chassis frame 112 is mounted at each side of the trailing end on a pair of larger wheels 114*a* and 114*b*. The operator's station 124 is mounted over the pair of wheels on the shoulder side of the road so that the operator, 125 is removed from traffic hazards. A variety of hydraulic lines are shown following the chute 65 and boom 35 to the operator's station 124 and operator controls which include the hand controls 126 and foot controls 127. The various hydraulic lines lead from the swing hydraulic cylinder 36, boom hydraulic cylinder 62, chute hydraulic cylinder 76, deflector hydraulic cylinder 78, and leveling bar hydraulic cylinder 110. A line is also provided for delivering diesel oil or other petroleum fluid to the row of nozzles, not visible, in the spray boom 91 over the cleaning mat 93, adjacent to scraper bar 116. All of these operational controls are accessed at the safe location of the operator's station 124 for fine control over placement, leveling and rolling and repair material.

In the example of FIG. 8 the entire roller assembly 90 has been rotated 90° from the standard position shown in FIG. 7. Thus, under normal operating conditions the roller 94 mounted in roller frame 92 of roller assembly 90 rolls, patches and repairs sites with a rolling direction that follows the longitudinal direction of the road. However, for paving larger surface areas the orientation of the roller assembly 90 as shown in FIG. 8 permits leveling and rolling of larger areas across the roadway surface at right angles to the longitudinal direction. This is accomplished by rotating the entire roller assembly 90 on its mounting sleeve 98 which is rotationally coupled to the chute 65 on rotationally engaging flanges within the exterior mating plates 100 and 102.

The roller assembly permits pivoting, swivel or rotational motion of the roller about three orthogonal pivot axes or axes of rotation for rolling motion, self leveling rocking motion, and for angular orientation of the roller in different directions relative to the longitudinal direction of the roadway. In this respect the roller assembly of FIGS. 7 and 8 is analogous to a gimbal mounting. The gimbal type mounting of the roller assembly is particularly advantageous for applications of the machine beyond pothole patching and repair of targeted locations including paving of larger surface areas of roads and sidewalks by distributing and dispersing the repair material over the larger area using the leveling bar followed by rolling and pressing. Thus, by operator control over the boom and chute, the leveling bar follows the deposited material in one direction for first spreading the material followed by reversing the direction of the boom and chute and their rolling and pressing the distributed material with the level bar in raised position.

The present invention achieves considerable improvement in the safety of pothole patching and roadway repair activities by reason of the automated system which permits the operator to remain seated at the operator's station on the shoulder side of the machine away from traffic hazards. Workers do not have to mount and dismount the truck and walk on the roadway surface in the vicinity of traffic. Rather, the driver of the truck and the operator of the machine can remain at their respective operator seats communicating with each other by, for example, pre-established sound or visual signals such as horn signals, etc.

For road travel and transport of the machine particularly over longer distances and at higher speeds the invention provides a number of features. The smaller caster wheels 15 shown in FIG. 1 may be entirely removed. Thus, the wheels 15 can be mounted on removable jacks. The larger wheels 14 of FIGS. 1 and 2 and the double wheels 114*a* and 114*b* of FIG. 8 which may also be caster wheels for maneuverability, may be locked in place with pins so that they do not swivel during high speed travel. Of course, safety lights and tail lights are also provided for highway travel.

Alternatively, the entire pothole patching and paving machine may be lifted off the ground for transport. According to this arrangement hook chains or lift chains from a dump truck body extend and are secured to the sides of the machine frame. The dump truck body then lifts the entire machine off the ground. The machine can be pivotally secured to the back of the dump truck chassis at the truck hitch with spring loaded hitch pins or standard hitch pins. The dump truck body then retracts the hook chains lifting the entire machine above the roadway surface.

The invention has been described with respect to an apparatus embodiment suitable for transport along the roadway by towing with a dump truck or other vehicle and with a hopper bin and hopper conveyor mounted on the mobile chassis frame. The convention contemplates, however, a variety of alternative example embodiments within the scope of the invention. For example, the pothole patching and roadway surface repair and paving machine may be constructed without the hopper bin or hopper body and instead constructed and arranged for mounting directly under a preexisting hopper or spreader mounted on a truck or attached to a truck such as the type of spreader attachment described, for example, in the Bryant U.S. Pat. No. 3,393,875 for "Sanding Attachments for Dump Trucks". The machine, according to the present invention, may be mounted directly on a truck frame with the boom mounted and positioned below the conveyor at the back of the truck hopper body. Furthermore, the pothole patching and roadway surface and paving machine, according to the invention, can be provided with its own chassis and engine as an independent special purpose vehicle. While the invention has been described with reference to particular example embodiments, it is intended to cover all variations and equivalents within the scope of the following claims.

I claim:

1. Apparatus for patching potholes and repairing roadway surfaces and similar surfaces along the ground with repair material from a source of roadway surface repair material comprising:

a mobile chassis frame mounted on wheels for transport over a roadway;

an elongate boom mounted on the frame at an upwardly directed angle with the lower end of the boom formed with an opening positioned for receiving repair material dispensed from a source, said boom constructed and arranged with a boom conveyor extendig the length of the boom for conveying repair material dispensed from the source to the top of the boom, said boom mounted on the frame for movement of the boom right and left over a roadway surface on a vertical pivot axis and for movement of the boom up and down on a horizontal pivot axis for varying the upwardly directed angle of the boom;

an elongate chute pivotally mounted to the upper end of the boom at a downwardly directed angle, said elongate chute extending from the top of the boom to a location adjacent to the ground with a discharge opening in the longitudinal direction through the bottom end of the chute, said chute being pivotally mounted for varying the downwardly directed angle of the chute relative to the boom, said chute constructed and arranged to receive repair material conveyed to the top of the boom and to direct the repair material through the opening at the bottom end of the chute to a selected location on the ground;

leveling assembly means operatively coupled to the lower end of the chute for leveling and smoothing repair material dispensed from a source via the boom and chute to a selected location on a roadway surface and for movement of the leveling assembly means with the chute above the ground to the selected location and on the ground at the selected location;

swing control means for controlling pivotal motion of the boom from left to right on the frame;

boom control means for controlling pivotal motion of the boom up and down varying the upwardly directed angle and thereby effectively extending and retracting the end of the boom relative to the frame;

and chute control means for controlling pivotal motion of the chute relative to the boom for varying the downwardly directed angle of the chute and further effectively extending and retracting the bottom end of the chute relative to the frame said swing, boom and chute control means cooperating for accurate control of placement of repair material on a roadway surface dispansed via the boom and chute and controlled movement of the leveling assembly means above the ground and on the ground.

2. The machine of claim 1 further comprising an elongate hopper bin extending across the width of the frame for receiving and holding roadway surface repair material, said hopper bin formed with a base opening for dispensing repair material and a hopper conveyor mounted in the base of the hopper bin for conveying repair material to the base opening and for dispensing roadway material to the boom conveyor.

3. The apparatus of claim 1 wherein the leveling assembly means comprises a roller frame and roller, spraying means mounted on the roller frame over the roller, and spray control means for spraying pertroleum liquid over the surface of the roller for cleaning the roller surface and preventing repair material from sticking to the surface of the roller, and wherein the leveling assembly means further comprises scraper means mounted on the roller frame adjacent to the roller.

4. The machine of claim 1 wherein the chute is formed at its upper end with a widened opening for receiving repair material delivered at the top of the boom by the boom conveyor, and wherein the chute is tapered with a wider cross sectional area at the upper end and a narrower cross sectional area at the bottom end.

5. The machine of claim 1 wherein the leveling assembly means comprises a roller mounted at the lower end of the chute extending below the end of the chute so that the weight of the machine can be brought to bear on the roller for compressing repair material dispensed at a targeted location on a roadway surface and so that the roller can be lifted above a roadway surface for movement to a selected location by operation of the boom control means and chute control means, said roller being mounted on the side of the chute away from the chassis frame for visibility from the chassis frame of the repair material deposited at a target location.

6. The machine of claim 1 wherein the leveling assembly means comprises a roller frame and a roller mounted for rotation on a first horizontal axis of rotation for rolling repair material, said roller mounted for self leveling rocking motion on a second horizontal axis at right angles to the first horizontal axis, said levling assembly means further comprising a sleeve or flange rotatably coupled to the chute for rotation of the leveling assembly means about a substantially vertical axis for orienting the roller at different angles relative to the direction of a raodway and on different sides of the chute.

7. The machine of claim 1 wherein the leveling assembly means comprises a leveling bar frame pivotally mounted to the bottom end of the chute on a substantially horizontal pivot axis, and leveling bar frame control means for controlling the level of the leveling bar frame for leveling repair material deposited on a roadway surface.

8. The machine of claim 1 wherein the mobile chassis frame is formed on the side opposite said boom with a trailer coupling for towing of the frame by a truck.

9. The machine of claim 1 wherein the mobile chassis frame is further formed with an operator's seat mounted on the side of the frame at the shoulder side of the road and with operator controls adjacent to the operator's seat for operating the respective swing, boom and chute control means for controlling the placement of repair material dispensed from a source at targeted locations on a roadway surface and for control of movement of the leveling assembly means above the ground and on the ground.

10. The machine of claim 9 wherein the boom conveyor comprises an auger and auger motor mounted at the top of the boom, and further comprising a hopper bin mounted on the chassis frame for receiving and holding roadway surface repair material, said hopper bin formed with a base opening for dispensing repair material and a hopper auger at the base of the hopper bin constructed and arranged for transporting repair material in the bin to the base opening for dispensing repair material to the boom aurger and a hopper auger motor for turning the hopper auger, and further comprising boom auger motor control means and hopper auger motor control means positioned adjacent to the operator's seat for controlling the rate and quantity of repair material dispensed at the targeted location on the roadway surface.

11. The machine of claim 1 further comprising a deflector pivotally mounted at the bottom end of the chute for deflecting repair material dropping through the chute at an angle relative to the chute and deflector control means for controlling the pivotal angle of the deflector for fine control of accurate placement of repair material at a selected location on the ground.

12. The machine of claim 11 wherein the deflector comprises a truncated cone.

13. The machine of claim 1 wherein the boom comprises a first substantially horizontal length for positioning below a source of repair material and a second upwardly directed length joined to the substantially horizontal length and extending at an upward angle from the frame, said substantially horizontal length and upwardly directed length forming a unitary boom mounted on the frame for pivotal movement left and right and for pivotal movement up and down, and wherein the boom comprises an elongate housing with an opening at the top of the substantially horizontal length for receiving repair material dispensed from a source and wherein the boom conveyor is constructed and arranged along the length of said boom inside the housing.

14. The machine of claim 13 wherein the boom conveyor comprises an auger having a first substantially horizontal length and a second substantially upwardly directed length coupled together by a universal joint, and wherein the auger is formed with interleaving tabs extending from the auger on either side of the universal joint for continuous transport of repair material passing along the auger at the angle between the substantially horizontal length and the upwardly directed length.

15. The machine of claim 1 wherein the mobile chassis frame is formed with a swing platform and a cradle with rollers pivotally mounted on the platform for pivotal rolling motion of the cradle on a vertical pivot axis left and right over the platform, said boom being pivotally mounted to the cradle on a horizontal pivot axis for pivotal motion up and down relative to the cradle and pivotal motion left and right by rolling motion of the cradle on the platform.

16. The machine of claim 15 wherein the swing platform is formed with a forward bearing edge having the shape of an arc of a circle and wherein the cradle is formed with a depending engaging edge engaging the forward bearing edge of the swing platform for gripping the cradle to the swing platform during pivotal motion right and left.

17. The machine of claim 15 wherein the boom control means comprises a boom hydraulic cylinder coupled between the boom and the cradle, wherein the swing control means comprises a swing hydraulic cylinder coupled between the cradle and the chassis frame, and wherein the chute control means comprises a chute hydraulic cylinder coupled between the boom and the chute.

18. The machine of claim 17 further comprising a deflector pivotally mounted at the opening of the bottom of the chute for deflecting repair material dropping through the chute at an angle relative to the chute and fourth control means for controlling the pivotal angle of the deflector, said fourth control means comprising a deflector hydraulic cylinder coupled between the chute and the deflector.

19. The machine of claim 18 wherein the mobile chassis frame is formed with an operator's seat on the side of the frame and hydraulic controls positioned adjacent to the operator's seat for controlling the respective swing, boom, chute, and deflector hydraulic cylinders for operator control of placement of repair material dispensed from a source at targeted locations on a roadway surface.

20. A machine for patching potholes and repairing roadway surfaces comprising:

a mobile chassis frame mounted on wheels for transport over a roadway;

a hopper bin mounted on the frame for receiving and holding roadway surface repair material, said hopper bin formed with a base opening for dispensing repair material and a hopper conveyor for conveying repair material to the base opening;

a boom mounted on the frame at an upwardly directed angle with the lower end of the boom positoned below the hopper bin for receiving repair material dispensed from the hopper bin, said boom comprising a boom conveyor extending the length of the boom from the lower end beneath the hopper bin to the upper end of the boom, said boom mounted on the frame for movement of the boom right and left over a roadway surface on a vertical pivot axis and for movement of the boom up and down on a horizontal pivot axis for varying the upwardly directed angle of the boom and thereby effectively extending and retracting the upper end of the boom relative to the frame over a roadway surface;

an elongate hollow chute mounted at the upper end of the boom at a downwardly directed angle, said chute pivotally mounted to the boom for varying the downwardly directed angle, said chute positioned and arranged for receiving repair material conveyed by the boom conveyor to the upper end of the boom and for guiding and dropping the repair material through the chute to a targeted location on a roadway surface at the lower end of the chute;

deflector means pivotally mounted at the lower end of the chute in the pathway of the chute for directing repair material dropping through the chute at an angle relative to the chute, pressure assembly means mounted adjacent to the lower end of the chute and extending below the end of the chute for compressing repair material deposited on the roadway surface at a targeted location;

swing control means for controlling pivotal motion of the boom left and right over a roadway surface on the vertical pivot axis;

boom control means for controlling pivotal motion of the boom up and down on the horizontal pivot axis thereby varying the upwardly directed angle of the boom;

chute control means for controlling pivotal motion of the chute thereby varying the downwardly directed angle of the chute;

and deflector control means for controlling the angle of the deflector, said mobile chassis frame formed with an operator station on the frame and operator controls operatively coupled for controlling the swing control means, boom control means, chute control means and deflector control means for placement of repair materail under operator control at targeted locations on a roadway surface and for bearing the weight of the machine on the pressure assembly means for compressing repair material dispensed on the roadway surface.

21. The machine of claim 20 wherein said swing control means, boom control means, chute control means and deflector control means comprise hydraulic cylinders, wherein said operator control comprise hydraulic operator controls, and wherein the boom conveyor comprises a boom conveyor motor mounted at the upper end of the boom for operating the conveyor, wherein the hopper bin comprises a hopper conveyor mounted in the base of the hopper bin and a hopper conveyor motor for operating the hopper conveyor, and wherein said operator station and operator controls comprise conveyor motor controls for controlling the dispensing rate and quantity of repair material.

22. The machine of claim 20 wherein the mobile chassis frame comprises a flat swing stage or platform and a cradle with rollers, said cradle pivotally mounted on a vertical pivot axis for rolling left and right on the swing platform, and wherein the boom is pivotally mounted to the cradle on a horizontal pivot axis for pivotal motion up and down relative to the cradle and frame and for pivotal motion right and left by the rolling motion of the cradle on the swing platform, wherein the boom comprises a substantially horizontal first length pivotally mounted on the cradle below the hopper bin with an opening in the top of the horizontal length for receiving repair material dispensed from the hopper bin and wherein the boom comprises an upwardly directed length extending at an upwardly directed angle from the cradle and frame, said substantially horizontal first length and upwardly directed second length forming a unitary boom, said boom conveyor extending throughout the substantially horizontal first length and upwardly directed second length.

23. The machine of claim 20 wherein the deflector comprises a deflector of truncated conical configuration pivotally mounted over the bottom end of the chute.

24. The machine of claim 20 wherein the pressure assembly means comprises a roller frame and a roller mounted for rotation on a first horizontal axis of rotation for rolling repair material, said roller being mounted for self leveling rocking motion on a second horizontal axis at right angles to the first horizontal axis, said pressure assembly means further comprising a sleeve or flange rotatably coupled to the chute for rotation of the pressure assembly means on a substantially vertical pivot axis for positioning the roller at different angles relative to the direction of a roadway and on different sides of the chute.

25. The machine of claim 20 wherein the pressure assembly means comprises a leveling bar frame pivotally mounted to the bottom end of the chute on a substantially horizontal pivot axis and leveling bar frame control means for controlling the level of the leveling bar frame for leveling repair material deposited on a roadway surface.

26. Apparatus for patching potholes and repairing roadway surfaces with repair material from a source of roadway surface repair material comprising:

a mobile chassis frame mounted on wheels for transport over a roadway;

an elongate boom mounted on the frame at an upwardly directed angle with the lower end of the boom formed with an opening positioned for receiving repair material dispensed from a source, said boom constructed and arranged with a boom conveyor extending the length of the boom for conveying repair material dispensed from the source to the top of the boom, said boom mounted on the frame for movement of the boom right and left over a roadway surface on a vertical pivot axis and for movement of the boom up and down on a horizontal pivot axis for varying the upwardly directed angle of the boom;

an elongate chute pivotally mounted to the upper end of the boom at a downwardly directed angle, said chute pivotally mounted for varying the downwardly directed angle of the chute relative to the boom, said chute constructed and arranged to receive repair material conveyed to the top of the boom and drop the repair material through the chute to a selected location on the ground;

leveling assembly means coupled adjacent to the lower end of the chute for leveling and smoothing repair material dispensed from a source via the boom and chute to a selected location on a roadway surface;

truncated cone deflector means pivotally mounted over the lower end of the chute for deflecting repair material at an angle relative to the chute;

swing control means for controlling pivotal motion of the boom from left to right on the frame;

boom control means for controlling pivotal motion of the boom up and down varying the upwardly directed angle and thereby effectively extending and retracting the end of the boom relative to the frame;

chute control means for controlling pivotal motion of the chute relative to the boom for varying the downwardly directed angle of the chute and further effectively extending and retracting the lower end of the chute relative to the frame;

truncated cone deflector control menas for accurate control of the angle of deflection and placement of repair material on a roadway surface dispensed via the boom and chute;

said leveling assembly means comprising leveling bar frame means pivotally mounted to the bottom end of the chute on a substantially horizontal pivot axis, and leveling bar frame control means for controlling the level of the leveling bar frame means for leveling repair material deposited on a roadway surface via the boom and chute.

27. Appartus for dispensing material from a source to a selected location on the ground comprising:

a supporting frame;

an elongate boom mounted on the frame at an upwardly directed angle with the lower end of the boom formed with an opening positioned for receiving material dispensed from a source, said boom constructed and arranged with a boom conveyor extending the length of the boom for conveying material dispensed from a source to the top of the boom, said boom mounted on the frame for movement of the boom right and left over a surface on a vertical pivot axis and for movement of the boom up and down on a horizontal pivot axis for varying the upwardly directed angle of the boom;

an elongate chute pivotally mounted to the upper end of the boom at a downwardly directed angle, said elongate chute extending from the top of the boom to a location adjacent to the ground with a discharge opening in the longitudinal direction through the bottom end of the chute, said chute being pivotally mounted for varying the downwardly directed angle of the chute relative to the boom, said chute constructed and arranged to receive material conveyed to the top of the boom and to direct the material through the opening at the bottom end of the chute to a selected location on the ground;

leveling means operatively coupled to the bottom end of the chute for leveling material dispensed from a source via the boom and chute on the ground and for movement of the leveling means with the chute above the ground to the selected location and on the ground at the selected location;

swing control means for controlling pivotal motion of the boom from left to right on the frame;

boom control means for controlling pivotal motion of the boom up and down varying the upwardly directed angle and thereby effectively extending and retracting the end of the boom relative to the frame;

and chute control means for controlling pivotal motion of the chute relative to the boom for varying the downwardly directed angle of the chute and further effectively extending and retracting the lower end of the chute relative to the frame said swing, boom and chute control means cooperating for accurate control of placement of material dispensed via the boom and chute to a selected location on the ground and for movement of the leveling means above the ground and on the ground.

* * * * *